US007675489B2

(12) United States Patent
Cheng

(10) Patent No.: US 7,675,489 B2
(45) Date of Patent: Mar. 9, 2010

(54) ENERGY EFFICIENT COLUMN DRIVER FOR ELECTROLUMINESCENT DISPLAYS

(75) Inventor: Chun-Fai Cheng, New Market (CA)

(73) Assignee: Ifire IP Corporation, Fort Saskatchewan, Alberta (CA)

( * ) Notice: Subject to any disclaimer, the term of this patent is extended or adjusted under 35 U.S.C. 154(b) by 860 days.

(21) Appl. No.: 11/338,013

(22) Filed: Jan. 24, 2006

(65) Prior Publication Data

US 2006/0186823 A1 Aug. 24, 2006

Related U.S. Application Data

(60) Provisional application No. 60/646,326, filed on Jan. 24, 2005.

(51) Int. Cl.
*G09G 3/30* (2006.01)

(52) U.S. Cl. ..... 345/76; 345/211; 345/212; 345/690

(58) Field of Classification Search ..... 345/76, 345/77, 211, 212, 213, 214, 690; 315/169.3, 315/224; 313/498; 257/258
See application file for complete search history.

(56) References Cited

U.S. PATENT DOCUMENTS 5,432,015 A 7/1995 Wu et al.
6,448,950 B1 9/2002 Cheng
2002/0134999 A1* 9/2002 Hirokawa et al. ..... 257/258
2003/0117421 A1* 6/2003 Cheng ..... 345/690

OTHER PUBLICATIONS

U.S. Appl. No. 10/701,051.

* cited by examiner

*Primary Examiner*—Amare Mengistu
*Assistant Examiner*—Dmitriy Bolotin
(74) *Attorney, Agent, or Firm*—Fay Sharpe LLP

(57) ABSTRACT

A driving circuit for driving a display panel having pixels arranged in rows and columns, wherein the driving circuit incorporates a resonant circuit that is able to efficiently recover capacitive energy stored on the row of pixels and transfer it to another row of pixels as the rows are addressed by the sequential application of a voltage on each row. The resonant circuit comprises a step down transformer, a capacitor across the primary winding, either the rows or columns of the display panel connected across the secondary winding and an input voltage and FET switches to drive the resonant circuit synchronous with the timing pulses governing the addressing of the display. The value of the capacitor connected across the transformer primary winding is chosen commensurate with the turns ratio on the transformer and the anticipated range of panel capacitance values to effectively limit variations in the resonance frequency with respect to the frequency of the timing pulses. The present invention is an improvement to the resonant driving circuit that employs column drivers that maximize energy recovery in the resonant circuit by employing a means to restrict current flowing through the FETs used to control the column voltage so that substantially all of the current that flows when charge is being removed from the display pixels during the time period between selection of active rows is constrained to flow back through the transformer to charge the primary capacitor.

18 Claims, 11 Drawing Sheets

Waveform distortion due to resonant frequency too high

Waveform distortion due to resonant frequency too low

Row drive polarity switch output showing +ve and -ve display cycle (6 lines per frame shown)

ENERGY EFFICIENT COLUMN DRIVER FOR ELECTROLUMINESCENT DISPLAYS

CROSS-REFERENCE TO RELATED APPLICATIONS

This application claims the benefit of U.S. Provisional Patent Application No. 60/646,326 filed on Jan. 24, 2005 for an invention entitled "Energy Efficient Column Driver for Electroluminescent Displays", the content of which is incorporated herein by reference.

BACKGROUND OF THE INVENTION

1. Field of the Invention

The present invention relates generally to flat panel displays, and more particularly to an improvement in resonant driving circuits employing column drivers that maximize energy recovery in the resonant circuit by restricting current flowing through output buffers of the column drivers used to control the column voltage.

2. Description of the Related Art

Electroluminescent displays are advantageous by virtue of their low operating voltage with respect to cathode ray tubes, their superior image quality, wide viewing angle and fast response time over liquid crystal displays, and their superior gray scale capability and thinner profile than plasma display panels. They do have relatively high power consumption, however, due to the inefficiencies of pixel charging, as discussed in greater detail below. This is the case even though the conversion of electrical energy to light within the pixels is relatively efficient. However, the disadvantage of high power consumption associated with electroluminescent displays can be mitigated if the capacitive energy stored in the electroluminescent pixels is efficiently recovered.

U.S. Pat. No. 6,448,950 teaches the combined use of sinusoidal driving and energy recovery from an electroluminescent display panel that has a widely varying capacitance. The resonant energy recovery circuit comprises a primary capacitor connected to the primary winding of a step-down transformer, with the secondary winding of the transformer connected through row or column drivers to the electroluminescent display panel. Separate resonant circuits are employed for rows and columns. The charge discharged from the display panel through the rows is efficiently captured in the primary capacitor and recycled to address the next row to be selected, but the energy discharged through the columns is not as efficiently captured and recycled. The reason for this lower efficiency of energy recovery through the columns has been found to be due to the partial discharge of the panel capacitance through undesirable shunting paths instead of through the energy recovery path to the resonant drive power supply.

SUMMARY OF THE INVENTION

Accordingly, it is an aspect to provide an improvement over U.S. Pat. No. 6,448,950, the contents of which are incorporated herein by reference. More particularly, a circuit is provided that improves the energy efficiency for the columns in a passively addressed electroluminescent display having a driving circuit using the sinusoidal resonant energy recovery concept set forth in U.S. Pat. No. 6,448,950.

The above aspect can be attained by a passive matrix display comprising a plurality of rows adapted to be scanned at a predetermined scanning frequency, a row driver for scanning the rows at the predetermined scanning frequency, a plurality of columns which intersect the rows to form a plurality of pixels characterized by a varying panel capacitance ($C_p$), a column driver having output buffers configured as voltage followers for applying output voltages to respective ones of the columns to provide gray-scale control of said pixels, a source of electrical energy, a resonant energy recovery circuit incorporating a step down transformer to reduce the effective panel capacitance ($C_p$), for receiving the electrical energy and in response generating a sinusoidal voltage to power the display at a resonance frequency which is substantially synchronized to the scanning frequency of the display, and a circuit for switching the output buffers to a high output impedance while the panel capacitance ($C_p$) is discharging so that substantially all discharge current from the panel capacitance ($C_p$) flows back through a secondary winding of the step-down transformer.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE EMBODIMENTS

Figure 1:
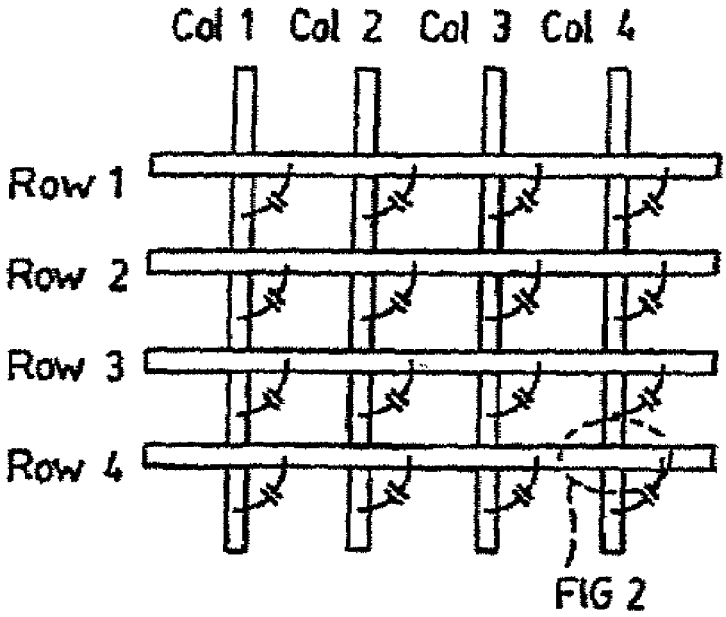
FIG. 1 is a plan view of an arrangement of rows and columns of pixels on an electroluminescent display, in accordance with the Prior Art.
Figure 2:
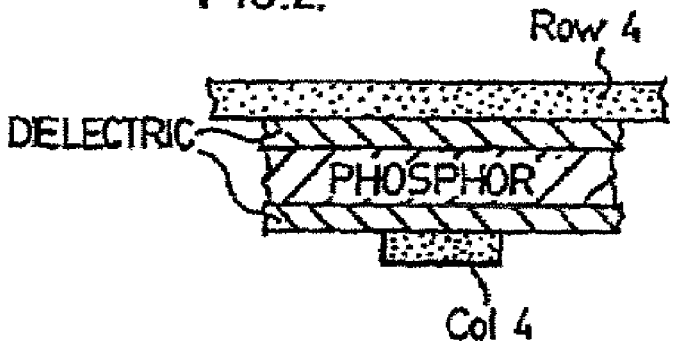
FIG. 2 is a cross-section through a single pixel of the electroluminescent display of FIG. 1.

As shown in FIGS. 1 and 2, an electroluminescent display panel has two intersecting sets of parallel electrically conductive address lines called rows (ROW 1, ROW 2, etc.) and columns (COL 1, COL 2, etc.) that are disposed on either side of a phosphor film encapsulated between two dielectric films. A pixel is defined at the intersection point between a row and a column. Thus, FIG. 2 is a cross-sectional view through the pixel at the intersection of ROW 4 and COL 4, in FIG. 1. Each pixel is illuminated by the application of a voltage across the intersection of its associated row and column. Matrix addressing entails applying a voltage below the threshold voltage to a row while simultaneously applying voltages of the opposite polarity to each column that intersects that row. The opposite polarity voltage augments the row voltage in accordance with the illumination desired on the respective pixels, resulting in generation of one line of the image. An alternate scheme is to apply the maximum pixel voltage to a row and apply column voltages of the same polarity to all columns with a magnitude up to the difference between the maximum voltage and the threshold voltage, in order to decrease the pixel voltages in accordance with the desired image. In either case, once each row is addressed, another row is addressed in a similar manner until all of the rows have been addressed. Rows not being addressed are left at open circuit. The sequential addressing of all rows constitutes a complete frame. Typically, a new frame is addressed at least about 50 times per second to generate what appears to the human eye as a flicker-free video image.

When each row of the electroluminescent display panel is illuminated, a portion of the energy supplied to the illuminated pixels is dissipated as current flows through the pixel phosphor layer to generate light, but a portion remains stored on the pixel once light emission has ceased. This residual energy remains on the pixel for the duration of the applied voltage pulse, and typically represents a significant fraction of the energy supplied to the pixel.

Figure 3:
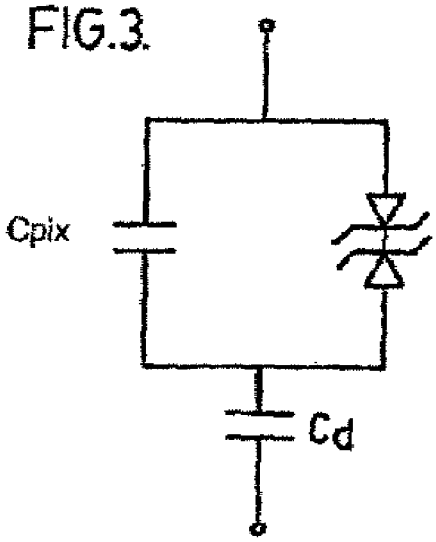
FIG. 3 is an equivalent circuit for the pixel of FIG. 2.

FIG. 3 is an equivalent circuit which models the electrical properties of a pixel. The circuit comprises two back-to-back Zener diodes with a series capacitor labeled $C_d$ and a parallel capacitor labeled $C_{pix}$. Physically, the phosphor and dielectric films (FIG. 2) are both insulators below the threshold voltage. This is represented in FIG. 3 by the situation where one Zener diode is not conducting so that the pixel capacitance is the capacitance of the series combination of the two capacitors $C_d$ and $C_{pix}$. Above the threshold voltage, the phosphor film becomes conductive, corresponding to the situation where both Zener diodes are conducting such that the pixel capacitance is equal to that of the series capacitor $C_d$ only. Thus, the pixel capacitance is dependent on whether the voltage is above or below the threshold voltage. Further, because all of the pixels on the display are coupled to one another through the rows and columns, all of the pixels on the display panel may be at least partially charged when a single row is illuminated. The extent of the partial charging of the pixels on non-illuminated rows is highly dependent on the variability of the simultaneous column voltages. In the case where all column voltages are the same, no partial charging of the pixels on non-illuminated rows occurs. In the case where about half of the columns have little or no applied voltage and the remaining half have close to the maximum voltage, the partial charging is most severe. The latter situation arises frequently in presentation of video images. The energy associated with this partial charging is typically much greater than the energy stored in the illuminated row, especially if there are a large number of rows, as in a high-resolution display. All of the energy stored in non-illuminated rows is potentially recoverable, and may amount to more than 90% of the energy stored in the pixels, particularly for display panels with a large number of rows.

Another factor contributing to energy consumption is the energy dissipated in the resistance of the driving circuit and the rows and columns during charging of the pixels. This dissipated energy may be comparable in magnitude to the energy stored in the pixels if the pixels are charged at a constant voltage. In this case, there is an initial high current surge as the pixels begin to charge. It is during this period of high current that most of the energy is dissipated since the dissipation power is proportional to the square of the current. Making the current that flows during pixel charging closer to a constant current can reduce the dissipated energy.

As discussed above, according to U.S. Pat. No. 6,448,950, an electroluminescent display driving method and circuit are provided that simultaneously recover and re-use the stored capacitive energy in a display panel and minimize resistive losses attributable to high instantaneous currents. These features improve the energy efficiency of the panel and driver circuit, thereby reducing their combined power consumption. Also, by reducing the rate of heat dissipation in the display panel and driver circuit, the panel pixels can be driven at higher voltage and higher refresh rates, thereby increasing brightness. An additional benefit is reduced electromagnetic interference due to the use of a sinusoidal drive voltage rather than a pulse drive voltage. The use of the sinusoidal drive voltage eliminates the high frequency harmonics associated with discrete pulses. The advantages given above are accomplished without the need for expensive high voltage DC/DC converters.

The energy efficiency of the display panel and driving circuit of U.S. Pat. No. 6,448,950 is improved through the use of two resonant circuits to generate two sinusoidal voltages, one to power the display rows and one to power the display columns. The row capacitance, as seen on the row pins of the display panel, forms one element of the resonant circuit for the row driving circuit. The column capacitance, as seen on the column pins of the display panel, forms one element of the resonant circuit for the column driving circuit.

The energy in each resonant circuit is periodically transferred back and forth between capacitive elements and inductive elements. The resonant frequency of each of the resonant circuits is tuned so that the period of the oscillations is matched as closely as possible, i.e. synchronized, to the charging of successive display panel rows at the scanning frequency of the display panel.

When the energy is stored inductively, a switch that connects the row resonant circuit to a particular row is activated so as to direct the energy stored inductively to the appropriate row as the rows are addressed in sequence. The row driving circuit for the rows also includes a polarity reversing circuit that reverses the row voltage on alternate frames in order to extend the service life of the display panel.

In a similar manner, the column driving circuit connects the column resonant circuit to all of the columns simultaneously so as to direct energy stored inductively to the columns. The column switches, as is taught in the conventional art, also serve to control the quantity of energy fed to each column in order to effect gray scale control. Typically, the row switches and column switches are packaged as an integrated circuit in sets of 32 or 64 and are respectively called row drivers and column drivers.

Figure 4:
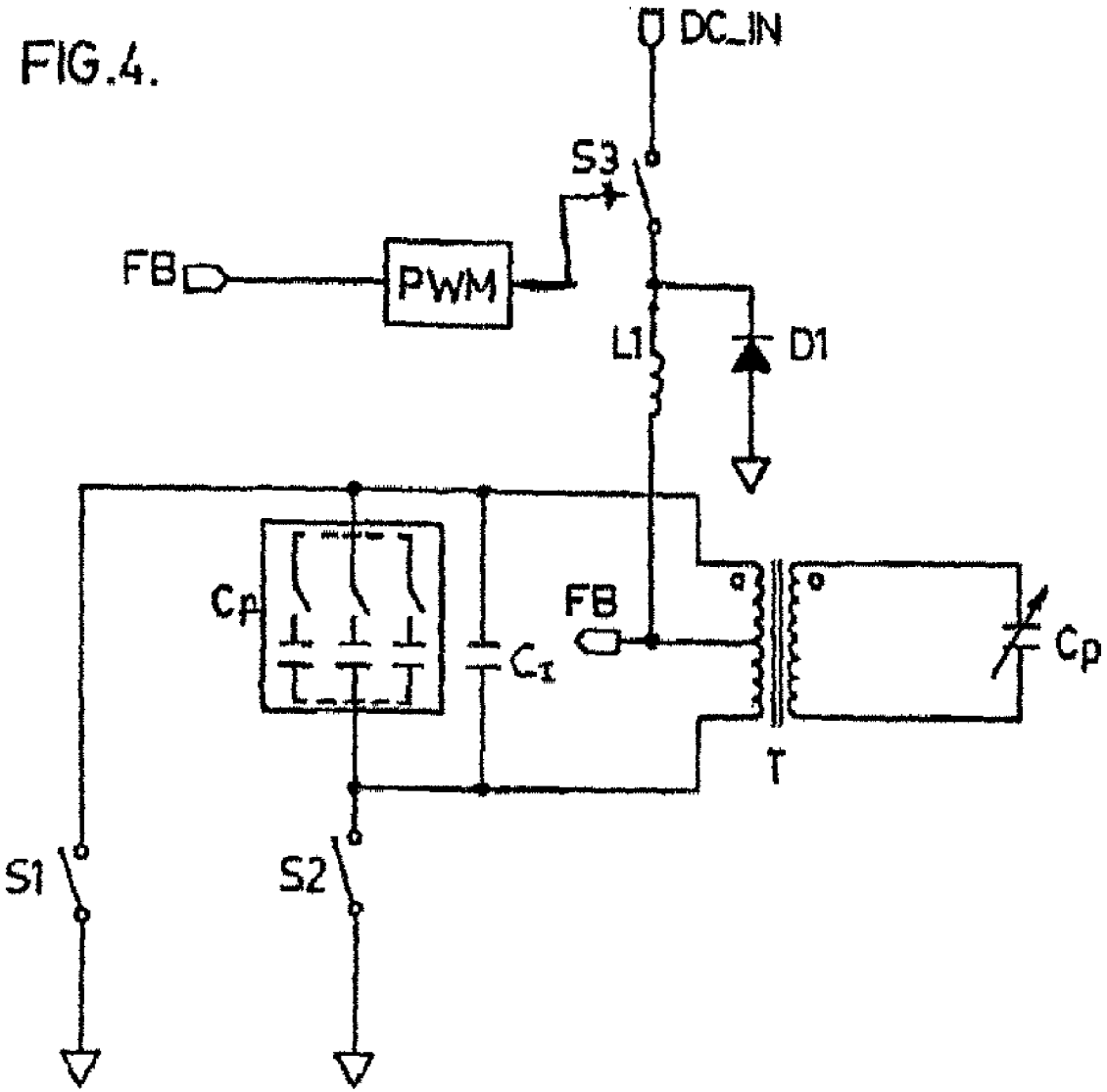
FIG. 4 is a simplified circuit schematic of a resonant circuit used in the display driver according to U.S. Pat. No. 6,448,950.

FIG. 4 is a simplified schematic of a resonant circuit according to U.S. Pat. No. 6,448,950. The basic element is a resonant voltage inverter forming a resonant tank that comprises a step down transformer (T), a capacitance corresponding to the display panel capacitance ($C_p$) connected across the secondary winding of the transformer and a further capacitance ($C_I$) connected across the primary winding of the transformer. The further capacitance may optionally include a further bank of capacitors ($C_f$) that can be selected to synchronize the resonant frequency with different display panel scanning frequencies.

The resonant circuit also comprises two switches ($S_1$ and $S_2$) that alternately open and close when the current is zero in order to invert an incoming sinusoidal signal to a unipolar resonant oscillation. An input DC voltage is chopped by switch ($S_3$) under control of a pulse width modulator (PWM) to control the voltage amplitude of the resonant oscillation. To stabilize the voltage of the oscillations, a signal (FB) is fed back from the primary of the transformer to the PWM to adjust the on-to-off time ratio for the switch ($S_3$) in response to fluctuations in the voltage on the secondary. This feedback compensates for voltage changes due to variations in the display panel impedance resulting, in turn, from changes in the displayed image. The display panel impedance is the impedance as seen on the row and column pins.

To operate efficiently, the resonant frequency of the driving circuit must not vary appreciably so that the resonant frequency remains closely matched to the frequency of row addressing timing pulses. The resonant frequency f is given by equation 1 below:

$$f=1/(2\pi(LC)^{1/2}) \quad (1)$$

where:

L is the inductance; and

C is the capacitance of the tank in the resonant circuit.

The resonant circuit must account for the variability in the display panel capacitance that contributes to the total tank capacitance. This is accomplished by use of the step down transformer which reduces the contribution of the display panel capacitance ($C_p$) to the tank capacitance so that the effective tank capacitance C is given by equation 2.

$$C=(n_2/n_1)^2C_P+C_I \quad (2)$$

where:

$C_P$ is the panel capacitance;

$C_I$ is the value of the capacitance across the primary winding of the transformer; and $n_1$ and $n_2$ are the number of turns respectively on the primary and secondary windings of the transformer.

Figure 5A:
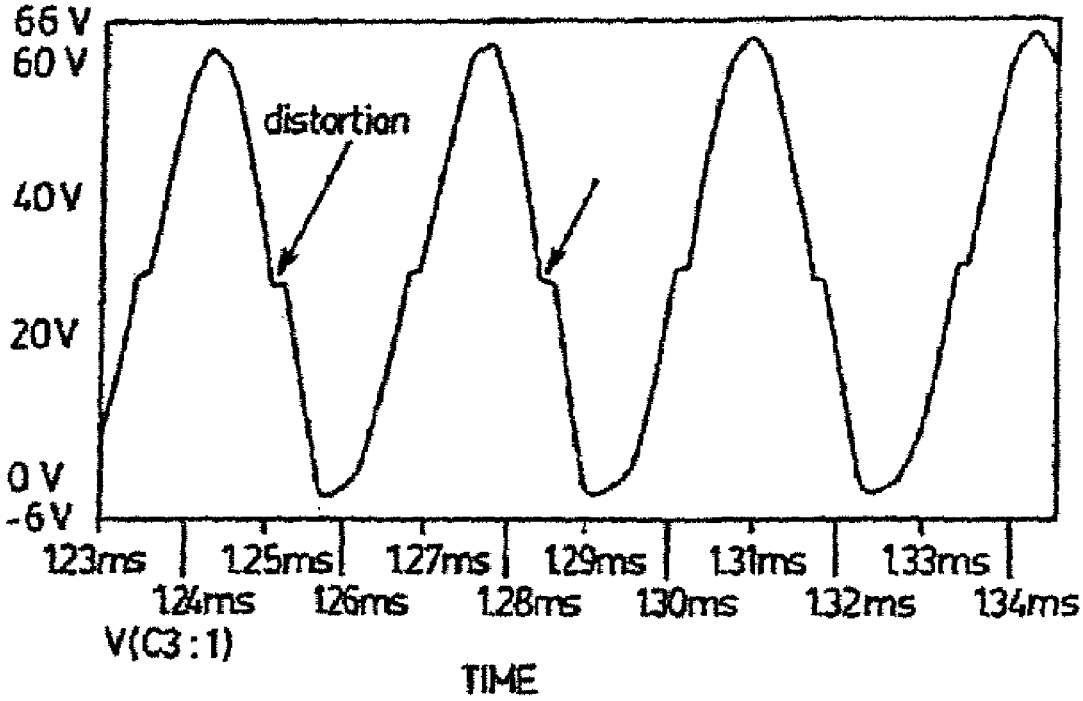
FIGS. 5A to 5C are oscilloscope tracings that show waveforms for the resonant circuit of FIG. 4 under different conditions.
Figure 5B:
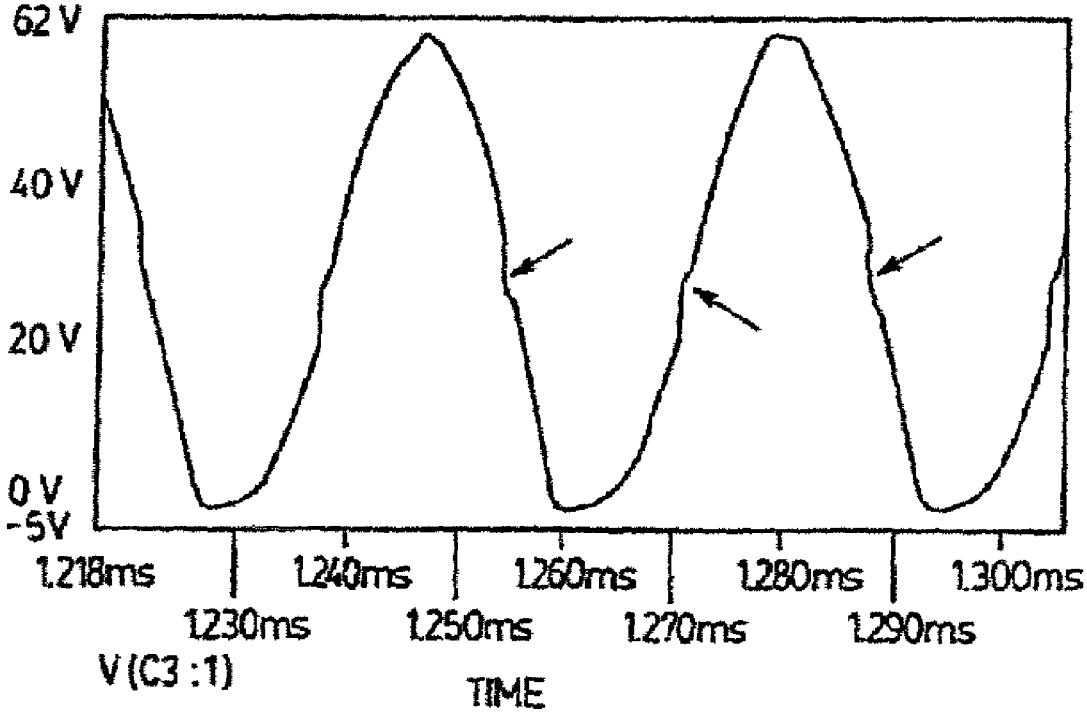
Figure 5C:
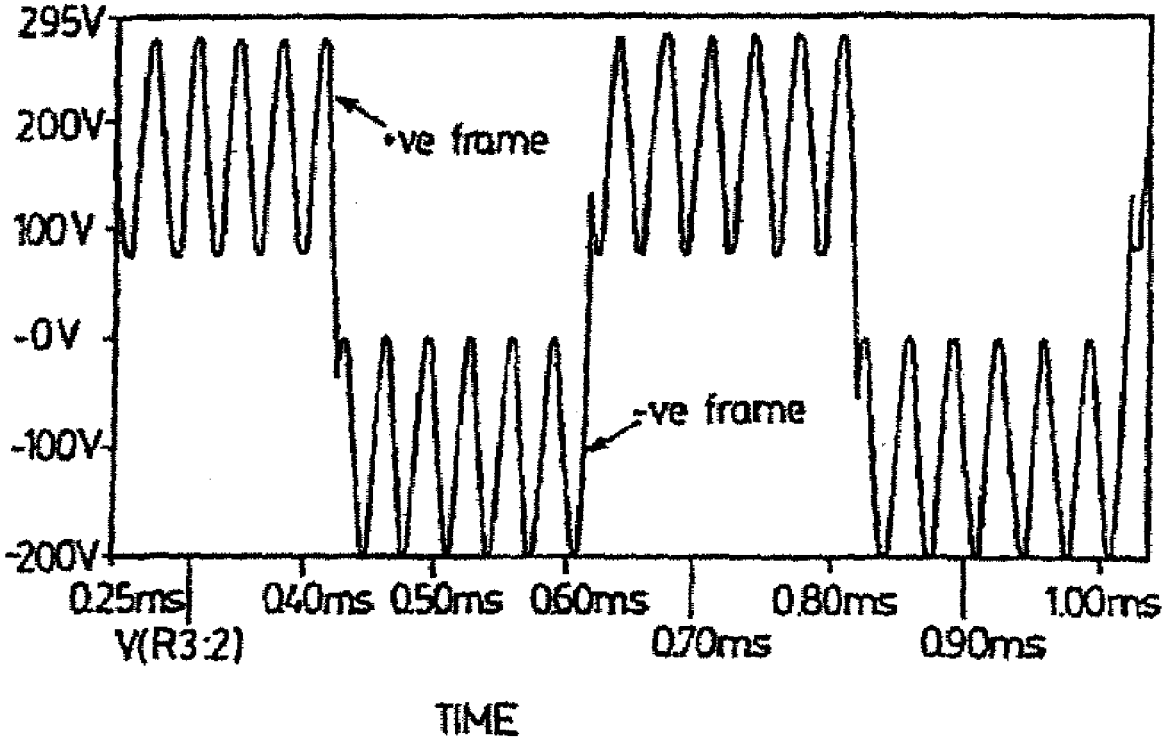

Values for the ratio of the number of turns ($n_2/n_1$) and capacitance $C_I$ are chosen so that the first term in equation 2 is small compared with the second term. Equation 2 is used as a guide in determining appropriate values for the turns-ratio and the primary capacitance for a particular display panel, and mutual optimization of these values is then accomplished by examining the voltage waveforms measured at the output of the resonant circuit. Component values are then selected to minimize the deviation from a sinusoidal signal. If the resonant frequency is too high, a waveform exemplified by that shown in FIG. 5A will be observed where there is a zero voltage interval between the alternate polarity segments of the waveform. Appropriate adjustments are then made using equations 1 and 2 as a guide. If the resonant frequency is too low, a waveform exemplified by that shown in FIG. 5B will be observed, where there is a vertical voltage step crossing zero volts connecting alternate polarity segments of the waveform. If the resonant frequency is well matched to the row addressing frequency, a nearly perfect sinusoidal waveform will be observed, as shown in FIG. 5C. However, in practice, fluctuations in the load will result in small frequency variations. Therefore, the DC input switching is usually set so that fluctuations in resonant frequency result in the resonant frequency being equal to or higher than the switching frequency so that deviations from the ideal resonant frequency result in the waveform shown in FIG. 5A. This is to avoid large current transients associated with the abrupt voltage changes at the switching point as shown in FIG. 5B. Large transient currents decrease the energy efficiency of the circuit by increasing ohmic loss.

In order to regulate the maximum value of the sinusoidal voltage waveform provided to the rows and columns in the presence of substantial variations in the capacitance of the display panel as seen through the rows and columns, the voltage is clamped to a substantially fixed value when the voltage to the rows or columns exceeds a predetermined value.

Figure 6:
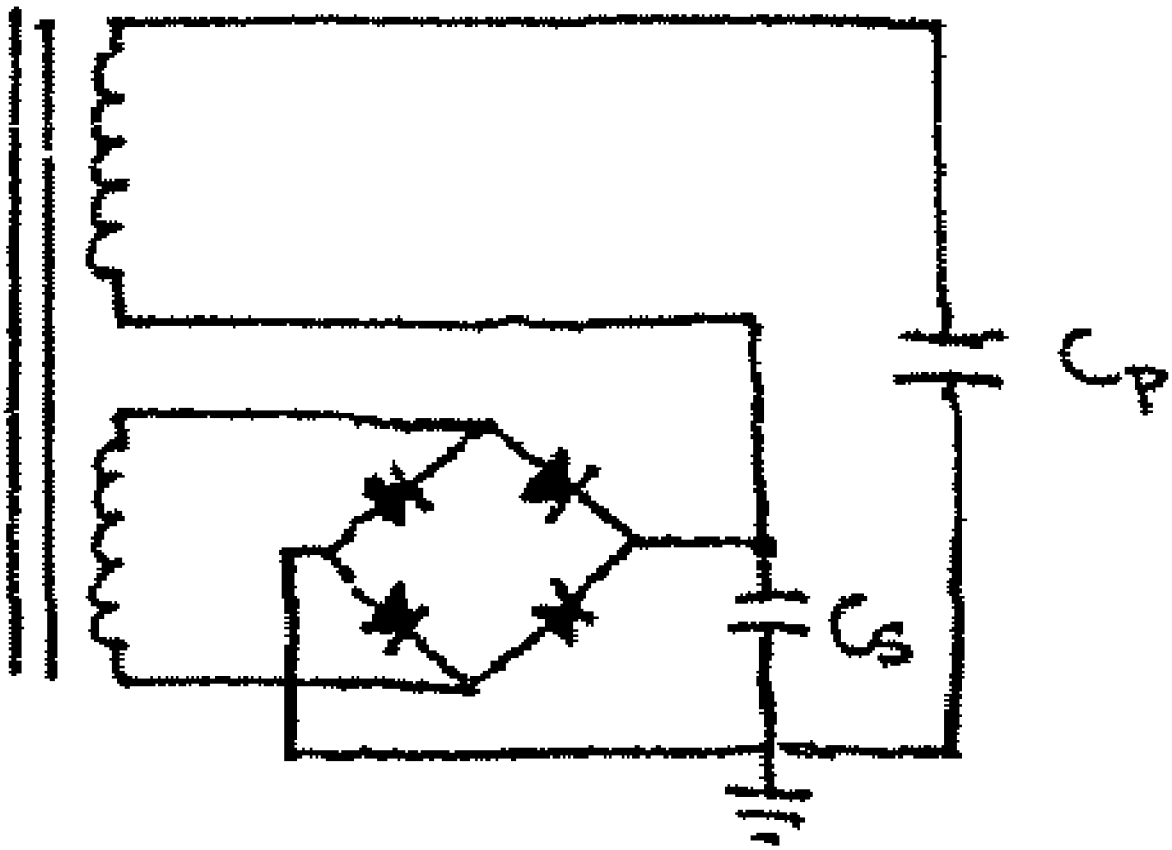
FIG. 6 is a simplified schematic of an improved transformer secondary side portion of the display driver of FIG. 4, as set forth in co-pending U.S. patent application No. 10/701,051, and in connection with which an embodiment is implemented.

To that end, a secondary winding on the step-down transformer T of FIG. 4 is connected to a full wave rectifier with a large storage capacitor connected across its output as shown in FIG. 6, and as described in co-pending U.S. patent application Ser. No. 10/701,051, the contents of which are incorporated herein by reference.

In operation the voltage applied to the display panel is clamped at a value that can be arbitrarily set by adjusting feedback to the pulse width modulator (PWM). For a heavy display panel load where the panel capacitance $C_P$ is near its maximum value, approximately 90% of the energy is arranged to flow to the secondary winding connected to the display panel for charging the display panel, and the remaining 10% charges the storage capacitor $C_S$. For an average load where the panel capacitance has an average value, approximately 50% of the energy is directed to charge the display panel and 50% is directed to the storage capacitor $C_S$. For a light load with the panel capacitance $C_P$ near a minimum approximately 10% of the energy is directed to the display panel and 90% is directed to the storage capacitor. Typically these conditions can be met if the voltage at the display panel is always positive with a minimum value of about 0.5 volts to ensure proper operation of switching ICs connected to the rows and columns of the display panel. Therefore, to ensure that the driving voltage to the display panel is always positive, the turns ratio of the secondary winding connected to the to full wave rectifier and storage capacitor $C_S$ to that of the second secondary winding connected to the display panel should be at least 1.05:1, preferably at least 1.1:1 and more preferably in the range 1.1:1 to 1.2:1. Also, the ratio of the capacitance of the storage capacitor to the maximum panel capacitance should be at least about 10:1 and preferably at least about 20:1, and most preferably at least 30:1.

The internal series resistance of the storage capacitor $C_S$ is chosen to be sufficiently low that voltage fluctuations across the capacitor due to resistive losses and the RC time constant do not exceed the specified regulation tolerance. Also, the turns ratio for the two secondary windings should take into account the forward voltage drop across the diodes in the rectifier that drive the storage capacitor and any resistive loss in the secondary circuits. The forward diode voltage drop can be minimized by selecting Schottky diodes for the rectifier.

During operation of the circuit according to FIG. 6, when a voltage pulse below the clamp voltage is applied to a row or column, energy from the primary winding is transferred mainly through the secondary winding connected across the display panel. At the same time, energy from the storage capacitor $C_S$ flows to the display panel. When the voltage exceeds the clamp voltage, energy is mainly transferred to both the storage and panel capacitors from the primary winding through the secondary winding connected to the rectifier in such a way that the storage and panel capacitors are charged in parallel. Since the parallel capacitance is dominated by the large capacitance of the storage capacitor $C_S$, there is only minimal increase in the voltage across the capacitors, and effective voltage regulation is achieved.

Longer term drift of the voltage across the storage capacitor $C_S$ over many pulses due to random changes in the displayed image can be eliminated by sensing the average voltage over many addressing cycles and providing feedback to the primary circuit, as set forth in U.S. Pat. No. 6,448,950. Thus, both short-term voltage fluctuations on the time scale of a single pulse and longer-term voltage fluctuations can be minimized to the extent required to maintain gray scale fidelity.

Figure 7:
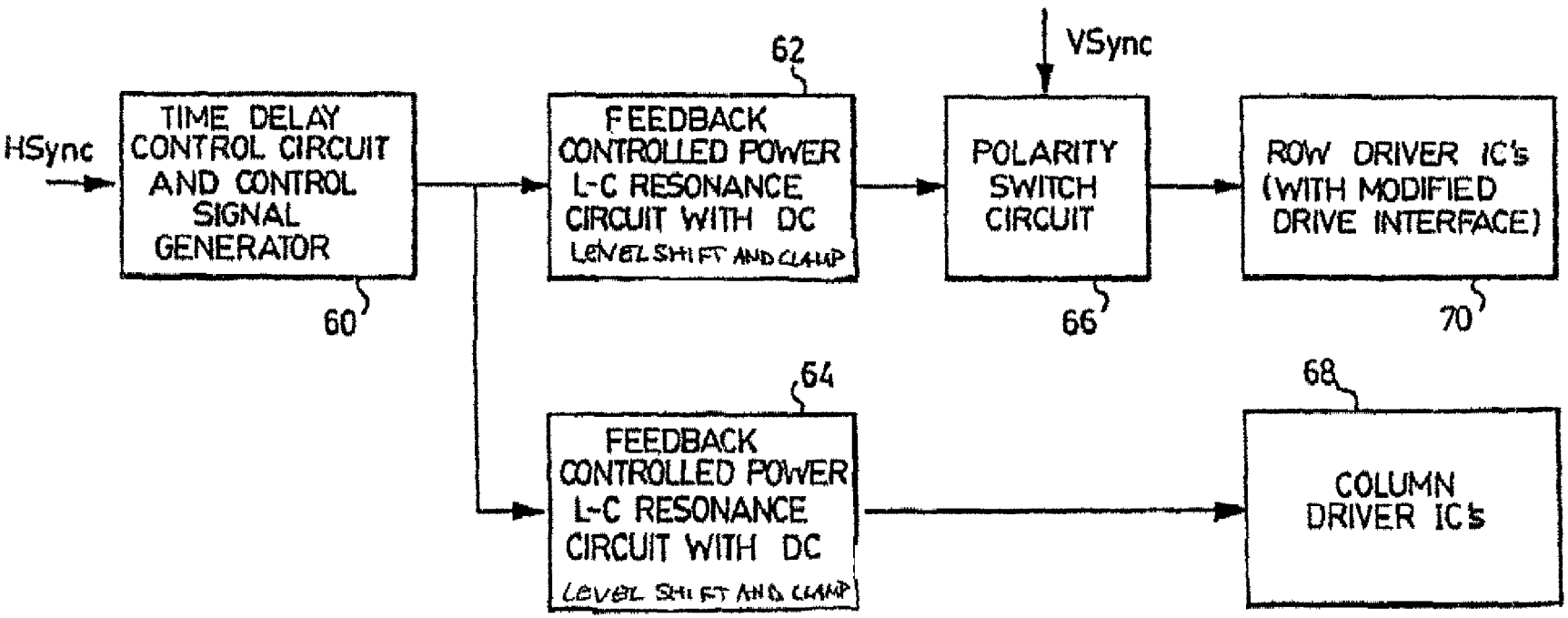
FIG. 7 is a block diagram of a driver circuit according to U.S. Pat. No. 6,448,950.

A block diagram of a complete display driver is shown in FIG. 7. In the diagram HSync refers to timing pulses that initiate addressing of a single row. The HSync pulses are fed to a time delay control circuit 60 where the delay time is set so that the zero current times in the resonant circuit will correspond to the switching times for the rows and columns. The output of circuit 60 is applied to row and column resonant circuits 62 and 64, and the output of circuit 62 is applied to a polarity switching circuit 66. The switching times for the polarity switching circuit 66 are controlled by the VSync pulses to control the timing for initiating each complete frame. The outputs of circuits 64 and 66 are clamped as described in greater detail below, and applied to the column and row driver ICs 68 and 70, respectively.

Returning momentarily to FIG. 2, thick film electroluminescent displays differ from conventional thin film electroluminescent displays in that one of the two dielectric layers comprises a thick film layer having a high dielectric constant. The second dielectric layer is not required to withstand a dielectric breakdown since the thick layer provides this function, and can be made substantially thinner than the dielectric layers employed in thin film electroluminescent displays. U.S. Pat. No. 5,432,015 teaches methods to construct thick film dielectric layers for these displays. As a result of the nature of the dielectric layers in thick film electroluminescent displays, the values in the equivalent circuit shown in FIG. 3 are substantially different than those for thin film electroluminescent displays. In particular, the values for capacitor $C_d$ can be significantly larger than they are for thin film electroluminescent displays. This makes the variation in panel capacitance as a function of the applied row and column voltages greater than it is for thin film displays. The ratio of the pixel capacitance above the threshold voltage to that below the threshold voltage is typically about 4:1 but can exceed 10:1. By contrast, for thin film electroluminescent displays this ratio is in the range of about 2:1 to 3:1. Typically the panel capacitance can range from the nanofarad range to the microfarad range, depending on the size of the display and the voltages applied to the rows and columns.

Figure 8:
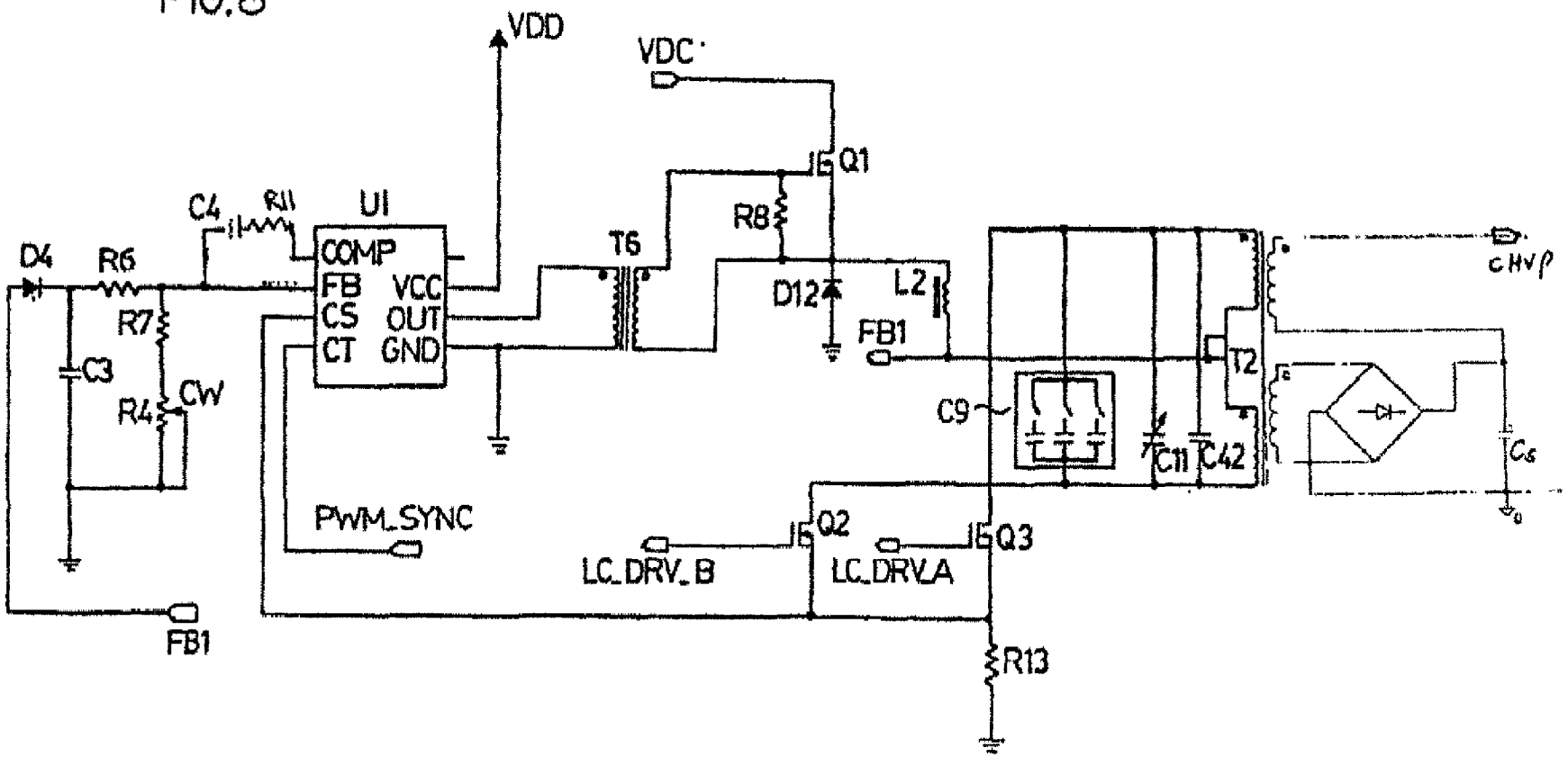
FIG. 8 is a circuit diagram of a column driver as set forth in co-pending U.S. patent application Ser. No. 10/701,051, and in connection with which an embodiment is implemented.
Figure 9:
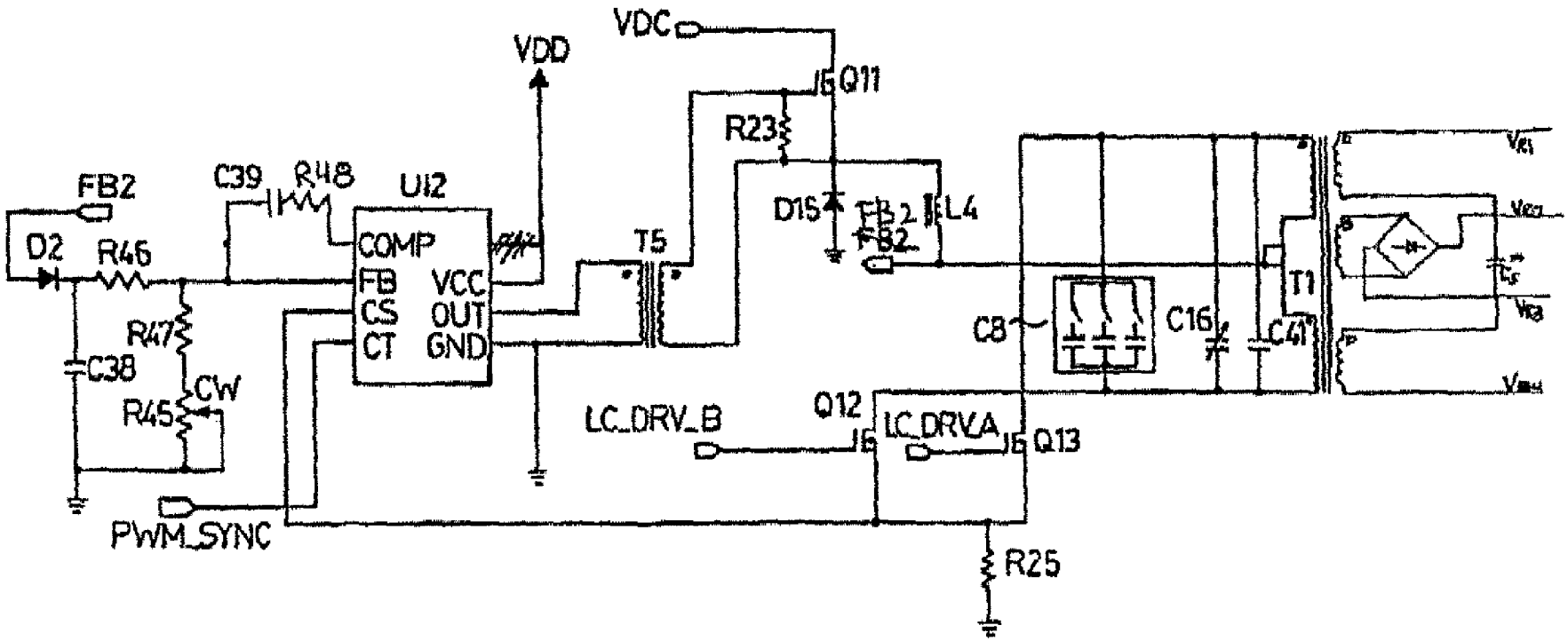
FIG. 9 is a circuit diagram of a row driver as set forth in co-pending U.S. patent application Ser. No. 10/701,051.
Figure 10:
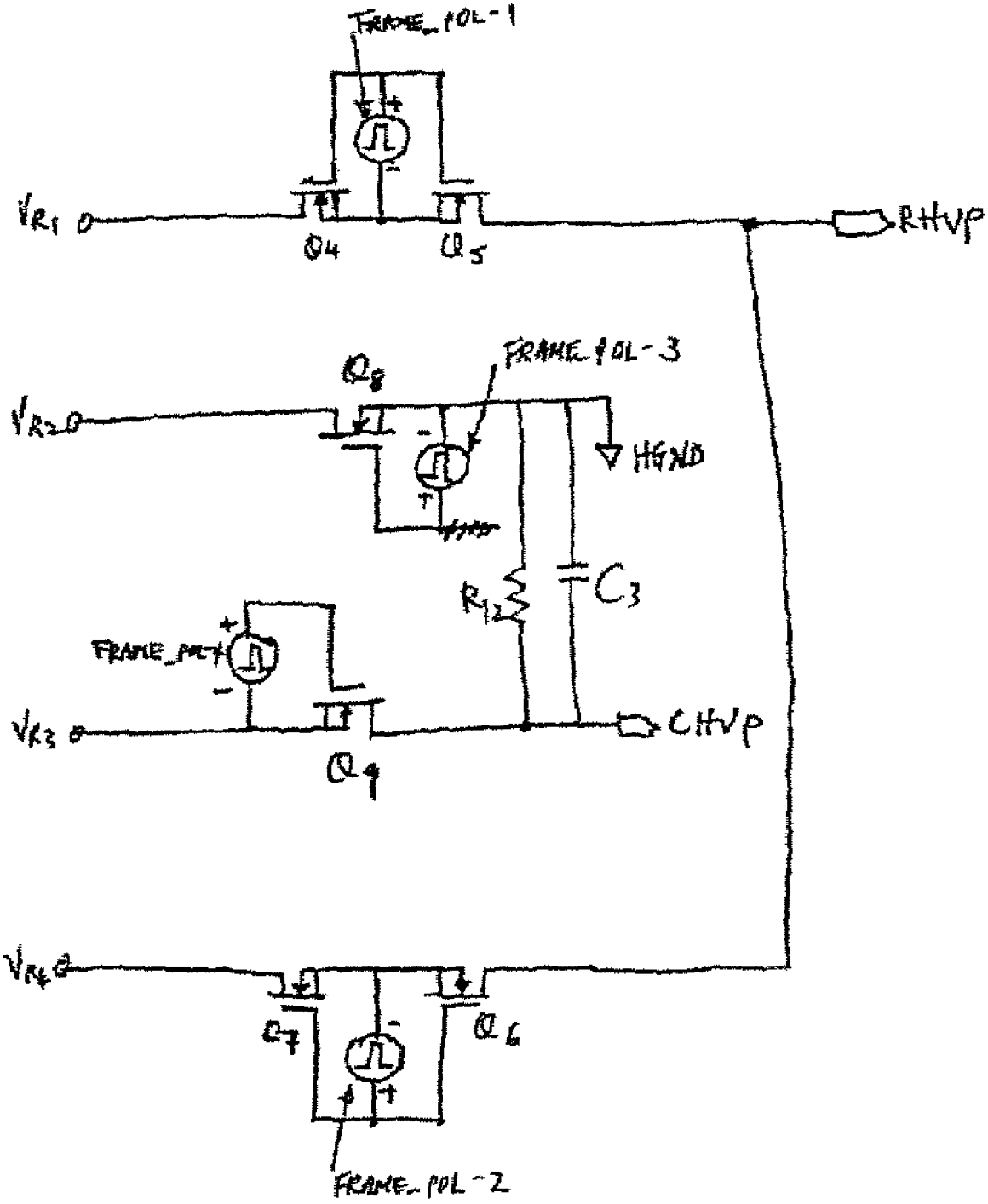
FIG. 10 is a circuit diagram of a polarity reversing circuit employed at the output of the row driver of FIG. 9.

FIGS. 8 and 9 are circuit schematics for the resonant circuits used for columns and rows, respectively, as set forth in U.S. patent application Ser. No. 10/701,051. FIG. 10 is a circuit schematic of a polarity reversing circuit connected between the row resonant circuit and the row drivers to provide alternating polarity voltage to the row driver high voltage input pins, also as set forth in U.S. patent application Ser. No. 10/701,051. The input DC voltage to the resonant circuits was 330 volts (rectified off-line from 120/240 volts AC). The output of the polarity reversing circuit is connected to the high voltage input pins of the row driver IC 70 (FIG. 7), the output pins of which are connected to the rows of the display panel. The clock and gate input pins of the row drivers are synchronized using digital circuitry employing field programmable gate arrays (FPGA's) adapted for matrix addressing of electroluminescent displays, as known in the art.

Figure 11:
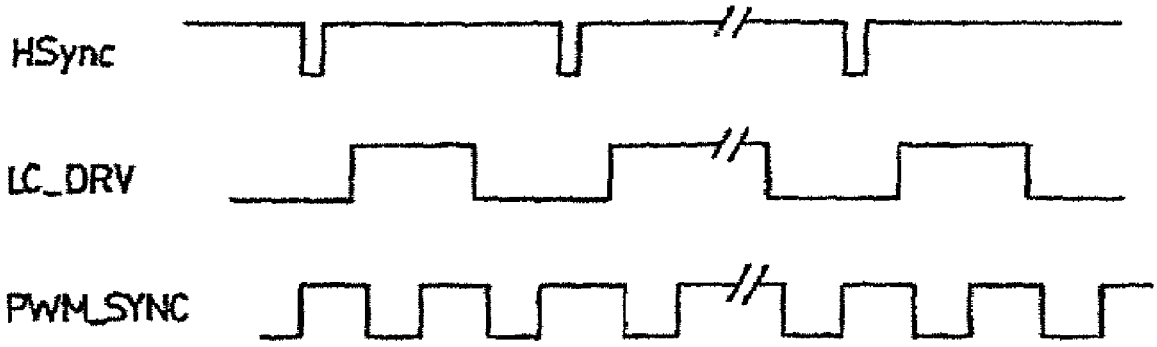
FIGS. 11 and 12 are timing diagrams showing display timing pulses used in the display driver set forth in FIGS. 6 to 10.
Figure 12:
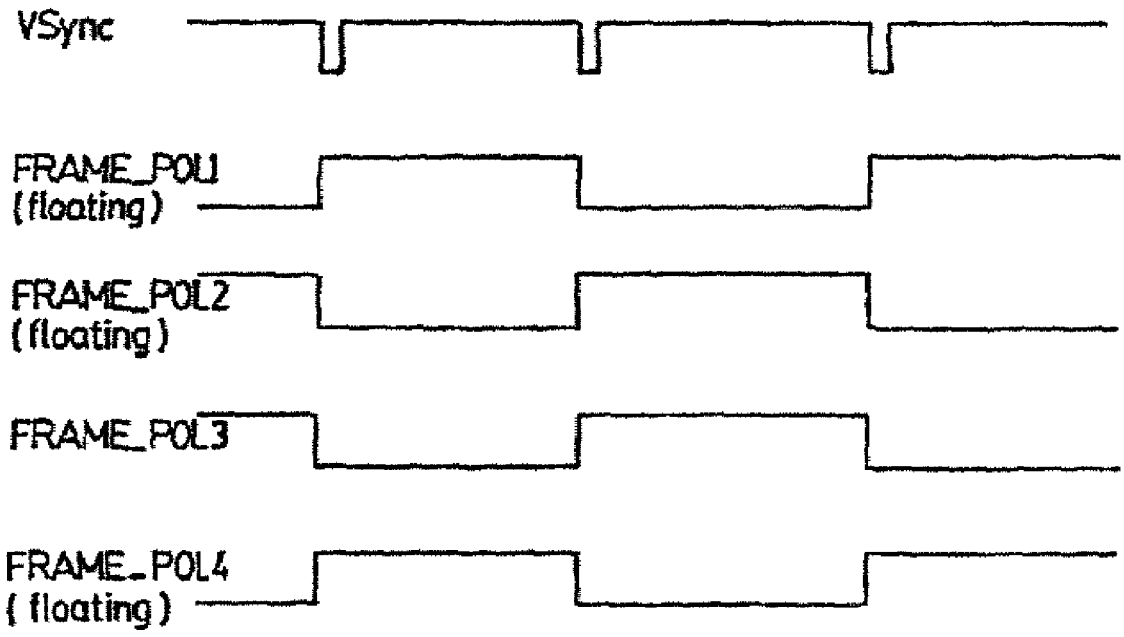

FIGS. 11 and 12 show the timing signal waveforms that are used to control the driver circuit, as shown in FIGS. 7, 8, 9 and 10. The row addressing frequency for the prototype display was 32 kHz, allowing a refresh rate of 120 Hz for the display panel.

With reference to FIG. 8, the resonant frequency of the column driving resonant circuit is controlled by the effective inductance seen at the primary of the step-down transformer T2 and by the effective capacitance of the capacitor C42 in parallel with the column capacitance as seen at the primary of transformer T2. There is also a small trimming capacitor C11 in parallel with capacitor C42 for fine tuning of the resonant frequency. The turns ratio for the transformer is greater than 5 and the value $C_I$ of the capacitor C42, with reference to equation 2, is chosen so that the value $C_I$ is substantially greater than $(n_2/n_1)^2 C_P$ to minimize the effect of changes in the panel capacitance on the resonant frequency. C9 is a bank of capacitors for tuning the tank circuit, in conjunction with the capacitance of capacitor C42, to obtain the desired resonant frequency to match or synchronize with different display scanning frequencies.

With further reference to FIG. 8, the sinusoidal output at the secondary of the transformer T2 is DC shifted by the voltage across the storage capacitor $C_S$ of the clamp circuit so that the instantaneous output voltage is never negative.

The resonant circuit is driven using the two MOSFETs Q2 and Q3, the switching of which is controlled by the LC DRV signal that is synchronized using an appropriate delay time with the HSync signal thereby causing the row driver ICs to select the addressed row. The delay is adjusted to ensure that switching of the row driver ICs occurs when the drive current is close to zero. The LC DRV signal is generated by the low voltage logic section of the display driver that is typically a field programmable gate array (FPGA) but may be an application specific integrated circuit (ASIC) designed for this purpose. The LC DRV signal is a 50% duty cycle TTL level square wave. The LC DRV signal has two forms: the LC DRV A signal is the complementary of the LC DRV B signal.

Again with respect to FIG. 8, control of the voltage level in the resonant circuit is achieved using the pulse width modulator U1 whose output is routed through the transformer T6 to the gate of the MOSFET Q1. This controls the voltage level in the resonant circuit by chopping the 330 volt input DC voltage. The inductor L2 limits the current to the resonant circuit as it is being energized from the DC voltage and the diode D12 limits voltage excursions at the source of the MOSFET Q1 due to current changes in the inductor. The duty cycle for the pulse width modulator is controlled by a voltage feedback circuit for sensing the voltage at the primary of the transformer T2 to regulate or adjust the resonant circuit voltage. The switching of the pulse width modulator is synchronized with HSync using the TTL signal PWM_SYNC from the low voltage logic section of the display driver.

With reference to FIG. 9, the operation of the row driver circuit is similar to that of the column driver circuit, except that the turns ratio of the transformer T1 as compared to that of the transformer T2 in the column driver circuit is different to reflect the higher row voltages and smaller values of the panel capacitance as seen through the rows, due to the fact that the remaining rows are at open circuit. There are also four more secondary windings on the transformer T1 than there are on transformer T2 to generate floating voltages required for operation of the polarity reversing circuit that alternates the polarity of the rows on successive frames.

The output of the row driver circuit feeds into the polarity reversing circuit shown in FIG. 10. This provides row voltages having opposite polarity on alternate frames to provide the required AC operation of the electroluminescent display. Six MOSFETs Q4 through Q9 form a set of analogue switches connecting either the positive or the negative sinusoidal drive waveforms generated to the panel rows. The selection of polarity is controlled by FRAME POL, a TTL signal generated by the system logic circuit in the display system. The FRAME POL signal is synchronized to the vertical synchronization signal VSYNC that initiates scanning of each frame on the display. The FRAME POL signal, together with four floating voltages from transformer T1, generates the control signals (FRAME_POL-1 to FRAME_POL-4) that operate the polarity reversing circuit.

As will be appreciated from the above discussion, a circuit that improves the energy efficiency of the resonant energy recovery circuit for the columns (FIG. 8) in a passively addressed electroluminescent display is provided.

When implemented as discussed above in connection with FIG. 8, the energy efficiency associated with driving the columns of the display panel is significantly lower than it is for driving the display rows. The reason for this lower efficiency of energy recovery through the columns has been found to be due to the partial discharge of the panel capacitance through undesirable shunting paths instead of through the energy recovery path to the resonant drive power supply.

Figure 13:
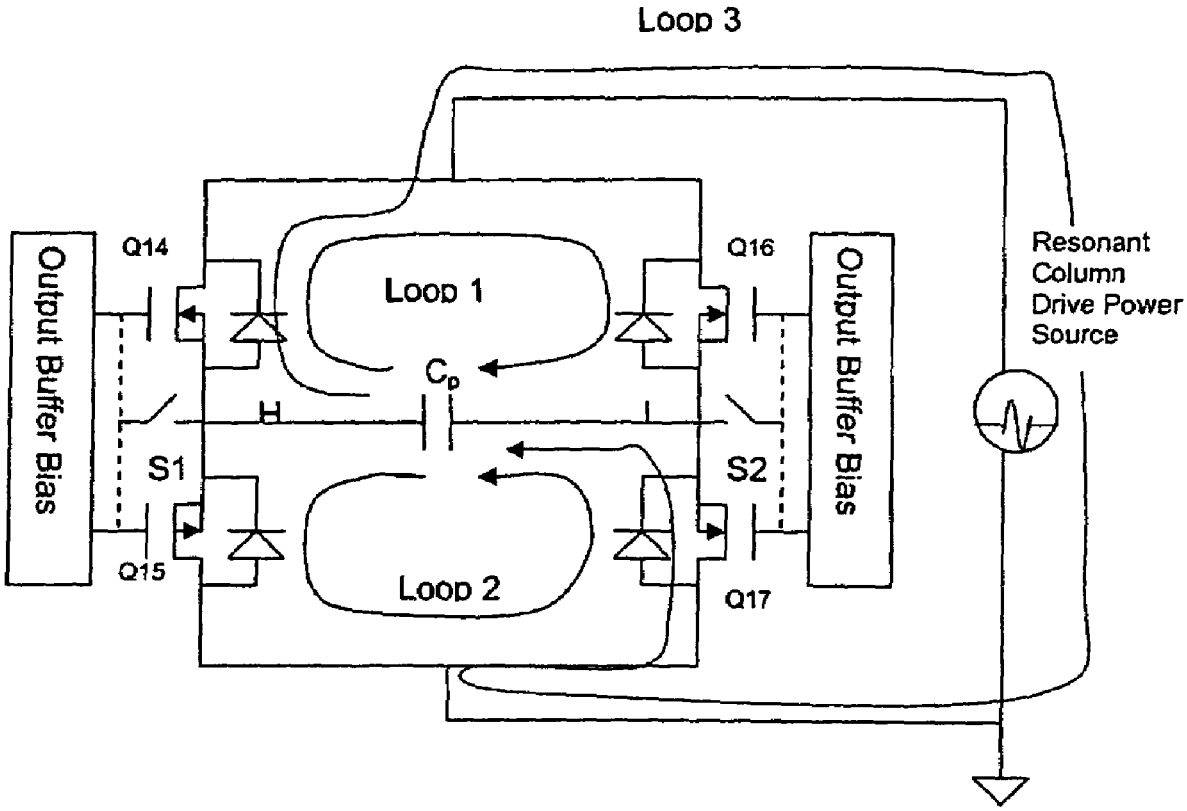
FIG. 13 is a schematic representation of an integrated sinusoidal energy recovery column driver and electroluminescent display.

FIG. 13 shows a simplified equivalent circuit of the panel column driver in the case where the video image consists of vertical bars. The selection of a vertical bar pattern simplifies the equivalent circuit because each of the column driver outputs is at one of two fixed voltages so that the columns can be represented by only two driver outputs each corresponding to the parallel group of column drivers at the two fixed voltages. The 'H' output represents the group of driver outputs with maximum gray-level which corresponds to the vertical bar, while the 'L' output represents the group of driver outputs with zero gray-level which corresponds to the background of the displayed bar pattern. Display of this pattern requires column voltages that maximize the power consumption of the column driver circuit.

The capacitor ($C_p$) connected between the 'H' and 'L' outputs represents the total panel capacitance.

The driver outputs are totem-pole MOSFET buffers in a source-follower configuration (Q14 to Q17).

During a scan cycle to address a row of the display panel, the panel capacitance (Cp) is charged to a voltage V which corresponds to the maximum gray-level. The energy stored in the capacitor is $\frac{1}{2}C_pV^2$. To maximize the efficiency of energy recovery, the panel capacitance must discharge through the body diodes of the MOSFETs Q14 and Q17 back to the resonant drive circuit, as shown in FIG. 8 (discharge loop 3).

However, during the discharge of the capacitor, the voltage levels at the terminals of the capacitor are continuously changing. Since the output buffers for the drivers are active voltage followers, the outputs are maintained at a level that corresponds to the required gray-level as controlled by a grayscale digital-to-analog conversion circuit contained within the column driver chips. Whenever there is a voltage difference between the driver output and the programmed gray-level voltage, it is a characteristic of the voltage follower buffer that either one of the totem-pole output MOSFETs will turn on in order to restore or maintain the programmed voltage at the driver output.

As a result, when the MOSFETs are turned on undesirable shunting discharge paths are established (discharge loops 1 & 2) that lead to dissipation of energy from the panel capacitors that cannot be recovered. These discharge shunting paths do not exist in the row driving circuitry (FIG. 9) since the row driver resembles a series on/off switch between the resonant drive power source and the addressed row panel capacitor, so that the only discharge path is through the switch back to the power source.

Accordingly, discharge of the panel capacitors through the driver output MOSFETs is prevented by ensuring that the output MOSFETs are in the 'off' state (or high impedance state) during discharge of the panel capacitor, so that the only discharge path of the panel capacitors is through the body diodes of the output MOSFETs back to the resonant power source of the efficient energy recovery circuit.

As shown in FIG. 13, analog switches (S1, S2) are provided to short-circuit the gate and source terminals of the output MOSFETs used to buffer the output voltage of the column drivers during panel capacitor discharge, such that these MOSFETs are switched to the 'off' or 'Hi-Z' state. Connecting the gate and source terminals ensures that the gate-to-source potential (Vgs) is below the turn-on threshold voltage of the MOSFETs.

A control circuit (not shown), internal to the column driver integrated-microcircuit, activates the analog switches (FIG. 13: S1, S2). The switches are closed, ideally, at all times that the panel capacitor is being discharged, but some benefit in efficiency is also gained if the switches are closed during a substantial portion of the time that the panel capacitor is being discharged. With reference to FIGS. 5A, 5B and 5C, the switches are preferably closed whenever the absolute value of the sinusoidal voltage waveform is falling, as this is the condition under which the panel capacitor is discharging.

A person of ordinary skill in the art may conceive of other embodiments or variations. For example, the circuit may be applied to any type of column driver buffer capable of providing a substantially sinusoidal output voltage waveform wherein the output impedance of the buffer as seen by the panel can be made to have high impedance whenever the panel capacitor is discharging, or during a substantial portion of the time when the panel capacitor is discharging.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A passive matrix display panel comprising:

a plurality of rows adapted to be scanned at a predetermined scanning frequency of said display;

a row driver for scanning said plurality of rows at said predetermined scanning frequency;

a plurality of columns which intersect said rows to form a plurality of pixels characterized by a varying panel capacitance ($C_p$);

a column driver having output buffers configured as voltage followers for applying output voltages to respective ones of said columns to provide gray-scale control of said pixels;

a resonant energy recovery circuit incorporating a step down transformer to reduce the effective panel capacitance ($C_p$) of said display, for receiving electrical energy and in response generating a sinusoidal voltage to power said display at a resonance frequency which is substantially synchronized to the scanning frequency of said display; and a circuit for switching said output buffers to a high output impedance while said panel capacitance ($C_p$) is discharging so that substantially all discharge current from said panel capacitance ($C_p$) flows back through a secondary winding of said step-down transformer of the resonant energy recovery circuit.

2. The passive matrix display panel of claim 1, wherein said circuit for switching includes a plurality of analog switches to short-circuit gate and source terminals of said output buffers while said panel capacitance ($C_p$) is discharging so that the gate-to-source potential of each of said buffers is below a turn-on threshold voltage thereof.

3. The passive matrix display panel of claim 2, wherein said circuit for switching comprises analog switches (S1, S2 . . . ) for establishing a short-circuit current path between the gate and source terminals of said output buffers.

4. The passive matrix display panel of claim 3, wherein said step down transformer has a primary winding across which a further capacitance ($C_I$) is connected, said panel capacitance ($C_p$) being connected across said secondary winding, wherein the value of said further capacitance ($C_I$) is sufficiently large relative to said panel capacitance ($C_p$) to maintain substantial synchronization of said resonance frequency to said scanning frequency; and a further secondary winding connected to a full wave rectifier with a storage capacitor ($C_S$) connected thereacross and in series with said panel capacitance ($C_P$) wherein the value of said storage capacitor ($C_S$) is sufficiently large relative to said panel capacitance ($C_p$) that (i) for a heavy panel load where the panel capacitance ($C_P$) is at or near its maximum value most of said electrical energy flows to the secondary winding for charging the panel and remaining energy charges the storage capacitor ($C_S$), (ii) for an average load where the panel capacitance has an average value approximately half of the energy flows to the panel and half of the energy flows to the storage capacitor ($C_S$), and (iii) for a light load where the panel capacitance is at or near a minimum value most of the energy flows to the storage capacitor and remaining energy flows to the panel.

5. The passive matrix display panel of claim 4, wherein the ratio of the capacitance of the storage capacitor ($C_S$) to the maximum panel capacitance is at least about 10:1.

6. The passive matrix display panel of claim 5, wherein the ratio of the capacitance of the storage capacitor ($C_S$) to the maximum panel capacitance is at least about 20:1.

7. The passive matrix display panel of claim 6, wherein the ratio of the capacitance of the storage capacitor ($C_S$) to the maximum panel capacitance is at least about 30:1.

8. The passive matrix display panel of claim 4, wherein said full wave rectifier incorporates Schottky diodes for minimizing forward diode voltage drop.

9. The passive matrix display panel of claim 4, wherein the turns ratio of the further secondary winding to that of the secondary winding is at least 1.05:1.

10. The passive matrix display panel of claim 4, wherein the turns ratio of the further secondary winding to that of the secondary winding is at least 1.1:1.

11. The passive matrix display panel of claim 10, wherein the turns ratio of the further secondary winding to that of the secondary winding is in the range 1.1:1 to 1.2:1.

12. The passive matrix display panel of claim 4, wherein said primary winding has $n_1$ turns and said secondary winding has $n_2$ turns such that $C_1 >> (n_2/n_1)^2 \times C_p$.

13. The passive matrix display panel of claim 4, further comprising an additional capacitor for changing said resonance frequency.

14. The passive matrix display panel of claim 1, further comprising a source of said electrical energy, said source comprising voltage means for generating a direct current voltage; and a pulse width modulator for chopping said direct current voltage into pulses of electrical energy.

15. The passive matrix display panel of claim 1, further comprising a controller for controlling the rate of electrical energy received by said resonant circuit to control fluctuations of said sinusoidal voltage due to a varying impedance of said display panel and energy usage by said display panel.

16. The passive matrix display of claim 15, wherein said controller further comprises a feedback circuit for sensing fluctuations of said sinusoidal voltage using an input from said resonant circuit and in response providing a feedback signal to said controller.

17. The passive matrix display of claim 16, wherein said input is from a primary winding of a step down transformer of said resonant circuit.

18. The passive matrix display of claim 17, wherein said sinusoidal voltage is clamped at a predetermined value by adjusting said feedback signal to said controller.

* * * * *